US011441767B2

(12) United States Patent
Matsunaga et al.

(10) Patent No.: US 11,441,767 B2
(45) Date of Patent: Sep. 13, 2022

(54) LAMP UNIT AND POWER SUPPLY ATTACHMENT

(71) Applicant: KOITO MANUFACTURING CO., LTD., Tokyo (JP)

(72) Inventors: Takashi Matsunaga, Shizuoka (JP); Yuji Sugiyama, Shizuoka (JP); Yukio Nomura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 17/609,200

(22) PCT Filed: May 1, 2020

(86) PCT No.: PCT/JP2020/018429
§ 371 (c)(1),
(2) Date: Nov. 5, 2021

(87) PCT Pub. No.: WO2020/226139
PCT Pub. Date: Nov. 12, 2020

(65) Prior Publication Data

US 2022/0205625 A1 Jun. 30, 2022

(30) Foreign Application Priority Data

May 7, 2019 (JP) ..... JP2019-087819
May 7, 2019 (JP) ..... JP2019-087821
May 7, 2019 (JP) ..... JP2019-087822

(51) Int. Cl.
*F21V 29/508* (2015.01)
*F21V 23/00* (2015.01)
(Continued)

(52) U.S. Cl.
CPC ..... *F21V 29/508* (2015.01); *F21S 41/32* (2018.01); *F21S 45/47* (2018.01); *F21V 23/003* (2013.01)

(58) Field of Classification Search
CPC ..... F21V 29/508; F21V 23/003; F21S 45/47; F21S 41/32
See application file for complete search history.

(56) References Cited

U.S. PATENT DOCUMENTS

2010/0008095 A1 1/2010 Tsukamoto
2015/0049499 A1 2/2015 Matsunaga
2015/0070921 A1 3/2015 Kim

FOREIGN PATENT DOCUMENTS

JP 2014-17274 A 1/2014
JP 2014-197550 A 10/2014
(Continued)

OTHER PUBLICATIONS

International Search Report (PCT/ISA/210) dated Jun. 30, 2020 issued by the International Searching Authority in International Application No. PCT/JP2020/018429.
(Continued)

*Primary Examiner* — Thomas M Sember
(74) *Attorney, Agent, or Firm* — Sughrue Mion, PLLC

(57) ABSTRACT

A lamp unit includes: a light emitting element; a reflector that reflects light emitted from the light emitting element toward a unit front; and a heat sink that supports the light emitting element and the reflector, in which a power supply attachment for supplying power to the light emitting element is attached to the heat sink, the power supply attachment is fastened to the heat sink at two left and right positions of the power supply attachment, and a connector portion of the power supply attachment is formed inside two left and right
(Continued)

fastening positions so as to extend to a unit rear side relative to a rear end position of the reflector.

16 Claims, 9 Drawing Sheets

(51) Int. Cl.
*F21S 45/47* (2018.01)
*F21S 41/32* (2018.01)

(56) References Cited

FOREIGN PATENT DOCUMENTS

| | | | |
|---|---|---|---|
| JP | 5658016 | B2 | 1/2015 |
| JP | 2016-139514 | A | 8/2016 |
| JP | 2017-212052 | A | 11/2017 |

OTHER PUBLICATIONS

Written Opinion (PCT/ISA/237) dated Jun. 30, 2020 issued by the International Searching Authority in International Application No. PCT/JP2020/018429.
Communication dated May 31, 2022 by the European Patent Office in European Patent Application No. 20802134.5.

LAMP UNIT AND POWER SUPPLY ATTACHMENT

TECHNICAL FIELD

The present disclosure relates to a power supply attachment and a lamp unit.

BACKGROUND ART

In a related art, there is a lamp unit in which a light emitting element and a reflector are supported by a heat sink as a configuration of the lamp unit including the light emitting element and the reflector that reflects light emitted from the light emitting element toward a unit front.

Patent Literature 1 discloses a lamp unit in which a power supply attachment for supplying power to a light emitting element is attached to a heat sink as a configuration of such a lamp unit.

The power supply attachment disclosed in Patent Literature 1 has a configuration in which the power supply attachment is fastened to the heat sink at two left and right positions of the power supply attachment, and a connector portion is formed at an end portion of the power supply attachment in a left-right direction. The power supply attachment includes an opening formed so as to surround the light emitting element, and the connector portion that accommodates a terminal portion electrically connected to an external power source, and the connector portion is formed at the end portion of the power supply attachment in the left-right direction.

On the other hand, Patent Literature 2 discloses a power supply attachment in which a connector portion is formed inside fastening positions to a heat sink at two left and right positions of the power supply attachment as a configuration of the power supply attachment for such a lamp unit. Patent Literature 2 discloses a configuration in which a reflector is fastened to the heat sink at two left and right positions of the reflector as the lamp unit in which a light emitting element and the reflector are supported by the heat sink.

In a related art, as disclosed in Patent Literature 1, for example, as the power supply attachment for supplying power to the light emitting element such as a light emitting diode, there is a configuration in which a pair of bus bar electrodes are embedded in an insulating member in a state where a part of the bus bar electrodes is exposed.

In the power supply attachment disclosed in Patent Literature 1, a pair of first terminal portions electrically connected to the light emitting element and a pair of second terminal portions electrically connected to the external power source are formed by an exposed portion of the pair of bus bar electrodes from the insulating member, and the opening that exposes the pair of first terminal portions and the connector portion that accommodates the pair of second terminal portions are formed in the insulating member thereof.

CITATION LIST

Patent Literature

Patent Literature 1: JP-A-2014-197550
Patent Literature 2: JP-A-2014-17274

SUMMARY OF INVENTION

Technical Problem

In the lamp unit disclosed in the above Patent Literature 1, in order to support a reflector with respect to the heat sink without interfering with the connector portion of the power supply attachment, it is necessary to increase a left-right width dimension of the lamp unit to some extent.

On the other hand, in the lamp unit disclosed in Patent Literature 2, the connector portion of the power supply attachment is formed inside two left and right fastening positions, but since the power supply attachment is formed so that the connector portion faces a unit front side, it is difficult to connect a connector of a power supply wiring to the power supply attachment depending on the configuration of the lamp unit.

For example, when the lamp unit is a projector-type lamp unit including the reflector, a unit component such as a projection lens, a solenoid, or a shade is disposed on the unit front side relative to the power supply attachment. Therefore, if the connector portion is formed so as to face the unit front side, it is difficult to connect the connector of the power supply wiring to the power supply attachment, and it is also difficult to shorten a front-rear length of the lamp unit.

The present disclosure has been made in view of such circumstances, and an object of the present disclosure is to provide a lamp unit in which a light emitting element and a reflector are supported by a heat sink and in which even when a power supply attachment is attached to the heat sink, a connector of a power supply wiring can be easily connected to the power supply attachment while reducing a left-right width dimension of the lamp unit.

In the lamp unit disclosed in the above Patent Literature 1, since the connector portion of the power supply attachment is positioned at the end portion of the power supply attachment in the left-right direction, when the reflector is fastened to the heat sink at two left and right positions of the reflector as disclosed in the above Patent Literature 2, in order to support the reflector with respect to the heat sink without interfering with the connector portion of the power supply attachment, it is necessary to increase the left-right width dimension of the lamp unit to some extent.

The present disclosure has been made in view of such circumstances, and also, an object of the present disclosure is to provide the lamp unit in which the light emitting element and the reflector are supported by the heat sink and in which even when the power supply attachment is attached to the heat sink, the left-right width dimension of the lamp unit can be reduced.

In the power supply attachment disclosed in the above Patent Literature 1, since the pair of second terminal portions are disposed side by side in an up-down direction in an internal space of the connector portion, a dimension of the connector portion in the up-down direction is increased, and it is difficult to reduce a thickness of the power supply attachment.

The present disclosure has been made in view of such circumstances, and an object of the present disclosure is to provide the power supply attachment that can reduce the thickness of the power supply attachment for supplying power to the light emitting element, and to provide the lamp unit including such a power supply attachment.

Solution to Problem

The present disclosure has been made in order to achieve the above object by devising a structure of the power supply attachment.

A lamp unit according to one aspect for achieving the above object is a lamp unit including: a light emitting element; a reflector that reflects light emitted from the light emitting element toward a unit front; and a heat sink that supports the light emitting element and the reflector, in which a power supply attachment for supplying power to the light emitting element is attached to the heat sink, the power supply attachment is fastened to the heat sink at two left and right positions of the power supply attachment, and a connector portion of the power supply attachment is formed inside two left and right fastening positions so as to extend to a unit rear side relative to a rear end position of the reflector.

The above "reflector" may be directly supported by the heat sink or may be supported by the heat sink via another member.

A specific fastening position of the above "power supply attachment" is not particularly limited as long as the power supply attachment is fastened to the heat sink at the two left and right positions of the power supply attachment, and a specific fastening method thereof is not particularly limited either. For example, screw tightening or caulking can be adopted.

A specific forming position, a direction of an opening of the connector portion, and the like of the above "connector portion" are not particularly limited as long as the connector portion is formed inside the two left and right fastening positions so as to extend to the unit rear side relative to the rear end position of the reflector.

The lamp unit according to the present disclosure has a configuration in which the power supply attachment is attached to the heat sink that supports the light emitting element and the reflector. Although the power supply attachment is fastened to the heat sink at the two left and right positions of the power supply attachment, the connector portion of the power supply attachment is formed inside the two left and right fastening positions so as to extend to the unit rear side relative to the rear end position of the reflector, so that a following effect can be obtained.

That is, according to the lamp unit of the present disclosure, a left-right width dimension of the power supply attachment can be made smaller than in a case where the connector portion is formed at the end portion of the power supply attachment in the left-right direction. As a result, since it is possible to easily support the reflector with respect to the heat sink without interfering with the connector portion of the power supply attachment, the left-right width dimension of the lamp unit can be reduced.

In addition, since the connector portion of the power supply attachment is formed so as to extend to the unit rear side relative to the rear end position of the reflector, it is possible to easily perform connection work between the power supply attachment and the connector of the power supply wiring by using a rear space of the reflector.

Thus, according to the present disclosure, in the lamp unit in which the light emitting element and the reflector are supported by the heat sink, even when the power supply attachment is attached to the heat sink, the connector of the power supply wiring can be easily connected to the power supply attachment while reducing the left-right width dimension of the lamp unit.

As in the present disclosure, the connector portion of the power supply attachment is formed so as to extend to the unit rear side relative to the rear end position of the reflector, so that when the connector of the power supply wiring is connected to the power supply attachment, the connection work can be performed in a state in which the connector portion of the power supply attachment is pressed. Therefore, it is possible to prevent a position of the reflector from being displaced from a desired position due to the reflector being inadvertently pressed during the connection work.

In the lamp unit according to one aspect for achieving the above object, the connector portion may be formed so as to open toward a unit rear.

According to the above configuration, it is possible to more easily perform the connection work of the connector of the power supply wiring.

In the lamp unit according to one aspect for achieving the above object, the connector portion may be formed so as to protrude toward a reflector side on the unit rear side relative to the rear end position of the reflector.

According to the above configuration, when the connector portion of the power supply attachment is positioned inside the two left and right fastening positions, it is necessary to form a recessed portion in the heat sink for avoiding interference with the connector portion. On the other hand, since a portion positioned inside the two left and right fastening positions in the heat sink is close to the light emitting element, it is highly necessary to dissipate heat generated by lighting of the light emitting element. Therefore, the connector portion of the power supply attachment is formed so as to protrude toward the reflector side on the unit rear side relative to the rear end position of the reflector, so that it is possible to make the recessed portion formed in the heat sink shallow in order to avoid interference with the connector portion, or not provide the recessed portion. Accordingly, by disposing the connector portion inside the two left and right fastening positions, it is possible to effectively prevent a heat dissipation function of the heat sink from being lowered.

In the lamp unit according to one aspect for achieving the above object, the connector portion may be formed at a center position of the two left and right fastening positions.

The "center position" means a position that intersects a vertical plane extending in a unit front-rear direction so as to pass through a center of the two left and right fastening positions.

According to the above configuration, even in a case where a pair of left and right lamp units are used such as vehicle lamps, for example, head lamps, it is possible to easily share the power supply attachment between the two lamp units.

In the lamp unit according to one aspect for achieving the above object, the reflector may be fastened to the heat sink at two left and right positions of the reflector, and a contact portion that is in contact with the heat sink may be formed at a portion of the reflector positioned on the unit rear side relative to the two left and right fastening positions.

According to the above configuration, a support of the reflector by the heat sink can be performed by a three-point support structure, and accordingly, a positioning accuracy of the reflector can be improved.

A specific forming position, a specific shape, and the like of the above "contact portion" are not particularly limited.

In the lamp unit according to one aspect for achieving the above object, the light emitting element may be mounted on an upper surface of the heat sink, and the upper surface of the heat sink may be formed by an inclined surface in which a region on which the light emitting element is mounted is inclined downward toward the unit rear.

According to the above configuration, a front-rear length of the lamp unit can be shortened by an amount that the region on which the light emitting element is mounted is inclined downward toward the unit rear. By adopting such a configuration, it is possible to increase an efficiency of incidence of light emitted from the light emitting element into the reflector.

The present disclosure has been made in order to achieve the above object by devising a fastening position of the reflector to the heat sink.

That is, the lamp unit according to one aspect for achieving the above object is a lamp unit including: a light emitting element; a reflector that reflects light emitted from the light emitting element toward a unit front; and a heat sink that supports the light emitting element and the reflector, in which the reflector is fastened to the heat sink at two left and right positions of the reflector, a power supply attachment for supplying power to the light emitting element is attached to the heat sink, the power supply attachment includes an opening formed so as to surround the light emitting element, and a connector portion that accommodates a terminal portion electrically connected to an external power source, the connector portion of the power supply attachment is positioned inside two left and right fastening positions of the reflector, and the two left and right fastening positions of the reflector are set to positions overlapping the opening of the power supply attachment with respect to a unit front-rear direction.

The above "reflector" may be directly supported by the heat sink or may be supported by the heat sink via another member.

A specific fastening method of the "reflector" to the heat sink is not particularly limited. For example, screw tightening or caulking can be adopted.

Specific positions of the above "two left and right fastening positions" are not particularly limited as long as the two left and right fastening positions are set at positions overlapping the opening of the power supply attachment with respect to the unit front-rear direction.

A specific arrangement and configuration of the above "connector portion" are not particularly limited as long as the connector portion is positioned inside the two left and right fastening positions of the reflector.

The lamp unit according to the present invention has a configuration in which the power supply attachment is attached to the heat sink that supports the light emitting element and the reflector, and the reflector is fastened to the heat sink at the two left and right positions of the reflector, but since the connector portion of the power supply attachment is positioned inside the two left and right fastening positions of the reflector, the left-right width dimension of the power supply attachment can be reduced as compared with the case where the connector portion is positioned at the end portion of the power supply attachment in the left-right direction as in the related art. Therefore, it is possible to easily support the reflector with respect to the heat sink without interfering with the connector portion of the power supply attachment, and accordingly, the left-right width dimension of the lamp unit can be reduced.

In addition, in the lamp unit according to the present invention, the two left and right fastening positions of the reflector are set to positions overlapping the opening of the power supply attachment with respect to the unit front-rear direction, so that as a configuration of the reflector, a left-right width dimension of the entire reflector including a flange portion or the like for fastening to the heat sink can be reduced, and accordingly, the left-right width dimension of the lamp unit can be further reduced.

Thus, according to the present invention, in the lamp unit in which the light emitting element and the reflector are supported by the heat sink, even when the power supply attachment is attached to the heat sink, the left-right width dimension of the lamp unit can be reduced.

In the lamp unit according to one aspect for achieving the above object, the power supply attachment may be fastened to the heat sink at two left and right positions of the power supply attachment, and the two left and right fastening positions of the reflector may be set on a unit front side relative to two left and right fastening positions of the power supply attachment.

According to the above configuration, the power supply attachment can be fastened to the heat sink without interfering with a fastening portion of the reflector to the heat sink.

In the lamp unit according to one aspect for achieving the above object, the reflector may include a first contact portion that is in contact with the heat sink at a portion of the reflector that is positioned on a unit rear side relative to the two left and right fastening positions of the reflector.

According to the above configuration, the support of the reflector by the heat sink can be performed by the three-point support structure, and accordingly, the positioning accuracy of the reflector can be improved.

The lamp unit according to one aspect for achieving the above object may further include a projection lens that allows reflective light from the reflector to be incident on the unit front side relative to the light emitting element, and a lens holder that supports the projection lens, in which the reflector may include a second contact portion that is in contact with the lens holder at a portion of the reflector that is positioned on the unit front side relative to the two left and right fastening positions the reflector.

According to the above configuration, it is possible to further improve the positioning accuracy of the reflector.

In the lamp unit according to one aspect for achieving the above object, the light emitting element may be mounted on an upper surface of the heat sink, and the upper surface of the heat sink may be formed by an inclined surface in which a region on which the light emitting element is mounted and a region on which the reflector is fastened are inclined downward toward the unit rear.

According to the above configuration, the front-rear length of the lamp unit can be shortened by an amount that the region on which the light emitting element is mounted and the region on which the reflector is fastened are inclined downward toward the unit rear. By adopting such a configuration, it is possible to increase the efficiency of incidence of the light emitted from the light emitting element into the reflector.

The present disclosure has been made in order to achieve the above object by devising an arrangement of the pair of second terminal portions.

That is, a power supply attachment according to one aspect for achieving the above object is a power supply attachment for supplying power to a light emitting element and in which a pair of bus bar electrodes are embedded in an insulating member in a state where a part of the bus bar electrodes is exposed, in which a pair of first terminal portions electrically connected to the light emitting element and a pair of second terminal portions electrically connected to an external power source are formed by an exposed portion of the pair of bus bar electrodes from the insulating member, an opening that exposes the pair of first terminal portions and the connector portion that accommodates the pair of second terminal portions are formed in the insulating member, and the pair of second terminal portions are disposed side by side in a horizontal direction in an internal space of the connector portion.

A type of the "insulating member" is not particularly limited. For example, a member made of resin, a member made of ceramics, or the like can be adopted.

A type of the "light emitting element" is not particularly limited. For example, a light emitting diode, a laser diode, or the like can be adopted.

A specific positional relationship between the "first terminal portion" and the "second terminal portion" is not particularly limited.

According to the above configuration, in the power supply attachment, the pair of first terminal portions electrically connected to the light emitting element and the pair of second terminal portions electrically connected to the external power source are formed by the exposed portion of a plurality of bus bar electrodes embedded in the insulating member from the insulating member. The opening that exposes the pair of first terminal portions and the connector portion that accommodates the pair of second terminal portions are formed in the insulating member, but the pair of second terminal portions are disposed side by side in the horizontal direction in the internal space of the connector portion. Therefore, a dimension of the connector portion in an up-down direction can be reduced, thereby making it possible to reduce the thickness of the power supply attachment.

Thus, according to the present disclosure, it is possible to reduce the thickness of the power supply attachment for supplying power to the light emitting element.

In the power supply attachment according to one aspect for achieving the above object, the connector portion is formed at a position overlapping the opening with respect to a first direction in which the pair of second terminal portions are disposed side by side.

According to the above configuration, even in a case where the power supply attachment is used in a pair of left and right lamp units such as vehicle head lamps, for example, the power supply attachment can be easily shared between the two lamp units.

In the power supply attachment according to one aspect for achieving the above object, each of the pair of second terminal portions is formed in a plate shape, and a plate surface faces a second direction orthogonal to the first direction in which the pair of second terminal portions are disposed side by side.

According to the above configuration, the dimension of the connector portion in the up-down direction can be further reduced, thereby making it possible to further reduce the thickness of the power supply attachment.

A lamp unit according to one aspect for achieving the above object includes:

the power supply attachment; an optical member that controls light emitted from the light emitting element; and a heat sink that supports the light emitting element, the power supply attachment, and the optical member, in which a recessed portion that accommodates at least a part of the connector portion is formed in the heat sink.

According to the above configuration, by forming the recessed portion in the heat sink, it is possible to easily avoid interference with the connector portion, and since the dimension of the connector portion in the up-down direction thereof is small, even if the recessed portion is formed in the heat sink, the recessed portion can be made shallow. Therefore, it is possible to effectively prevent the heat dissipation function of the heat sink from being lowered accordingly.

In the lamp unit according to one aspect for achieving the above object, an engagement hole that for engaging the connector portion with a connector on an external power source side may be formed in an upper wall portion of the connector portion.

According to the above configuration, by engaging the connector portion with the connector on the external power source side in the engagement hole, it is possible to easily maintain an electrical connection between the power supply attachment and the external power source due to a fitting between the connector portion and the connector on the external power source side, and it is possible to visually check a fitting state thereof in the engagement hole of the connector portion.

Advantageous Effects of Invention

According to the present disclosure, it is possible to provide the lamp unit in which the light emitting element and the reflector are supported by the heat sink and in which even when the power supply attachment is attached to the heat sink, the connector of the power supply wiring can be easily connected to the power supply attachment while reducing the left-right width dimension of the lamp unit.

According to the present disclosure, it is also possible to provide the lamp unit in which the light emitting element and the reflector are supported by the heat sink and in which even when the power supply attachment is attached to the heat sink, the left-right width dimension of the lamp unit can be reduced.

According to the present disclosure, it is also possible to provide the power supply attachment that can reduce the thickness of the power supply attachment for supplying power to the light emitting element, and to provide the lamp unit including such a power supply attachment.

DESCRIPTION OF EMBODIMENTS

Hereinafter, an embodiment of the present disclosure will be described with reference to the drawings.

Figure 1:
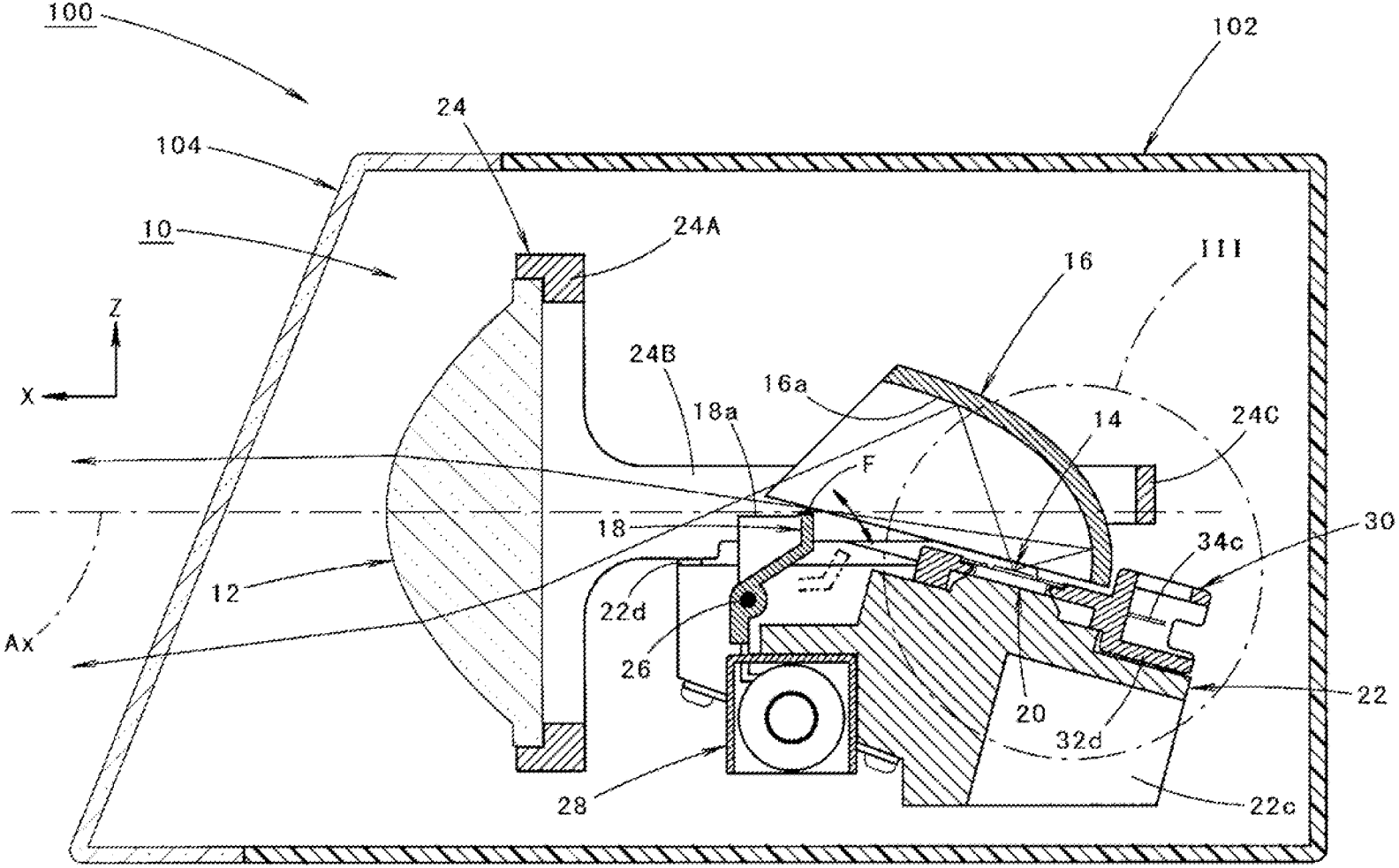
FIG. 1 is a side cross sectional view illustrating a vehicle lamp including a lamp unit according to an embodiment of the present disclosure.
Figure 2:
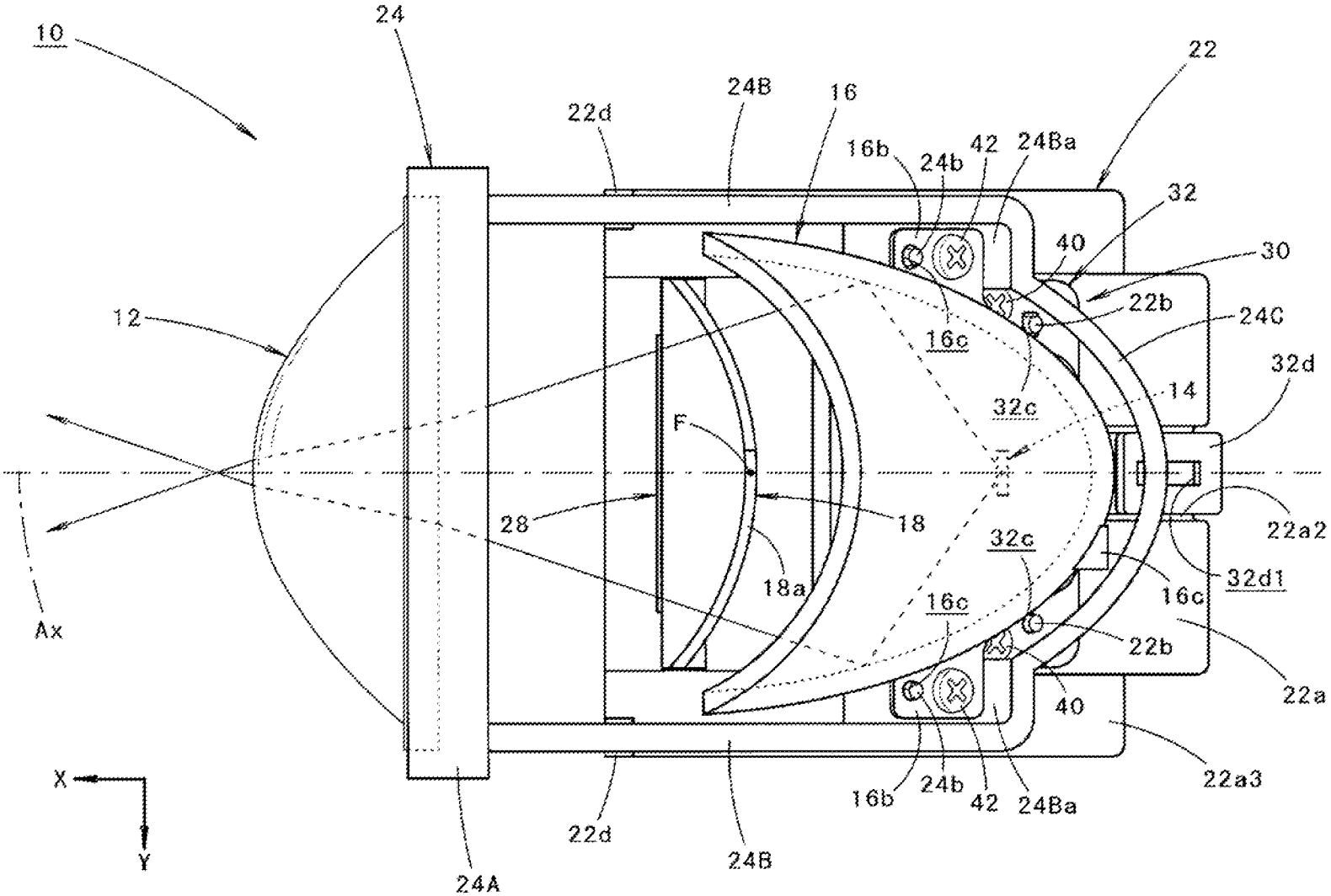
FIG. 2 is a plan view illustrating the lamp unit.

FIG. 1 is a side cross sectional view illustrating a vehicle lamp 100 including a power supply attachment 30 and a lamp unit 10 according to the embodiment of the present disclosure. FIG. 2 is a plan view illustrating the lamp unit 10.

In these drawings, a direction indicated by X is a "unit front", a direction indicated by Y is a "left direction" that is orthogonal to the "unit front" (a "right direction" in a front view of the unit), and a direction indicated by Z is an "up direction". The similar applies to the other drawings.

The vehicle lamp 100 is a head lamp provided at a front end portion of a vehicle, and is accommodated in a housing formed by a lamp body 102 and a translucent cover 104 in a state where a light axis adjustment is performed such that a front-rear direction of the lamp unit 10 (that is, a unit front-rear direction) coincides with a vehicle front-rear direction.

The lamp unit 10 includes a projection lens 12, alight emitting element 14 disposed on a unit rear side relative to a rear side focus point F of the projection lens 12, a reflector 16 that covers the light emitting element 14 from an upper side and reflects light emitted from the light emitting element 14 toward the projection lens 12, and a movable shade 18 disposed between the light emitting element 14 and the projection lens 12.

The projection lens 12 is a piano-convex aspherical lens having a convex front surface and a flat rear surface, and has a light axis Ax extending in the unit front-rear direction. The projection lens 12 is formed to project a light source image formed on a rear focal plane, which is a focal plane including the rear side focus point F of the projection lens 12, as an inverted image onto a virtual vertical screen in front of the lamp.

Figure 3:
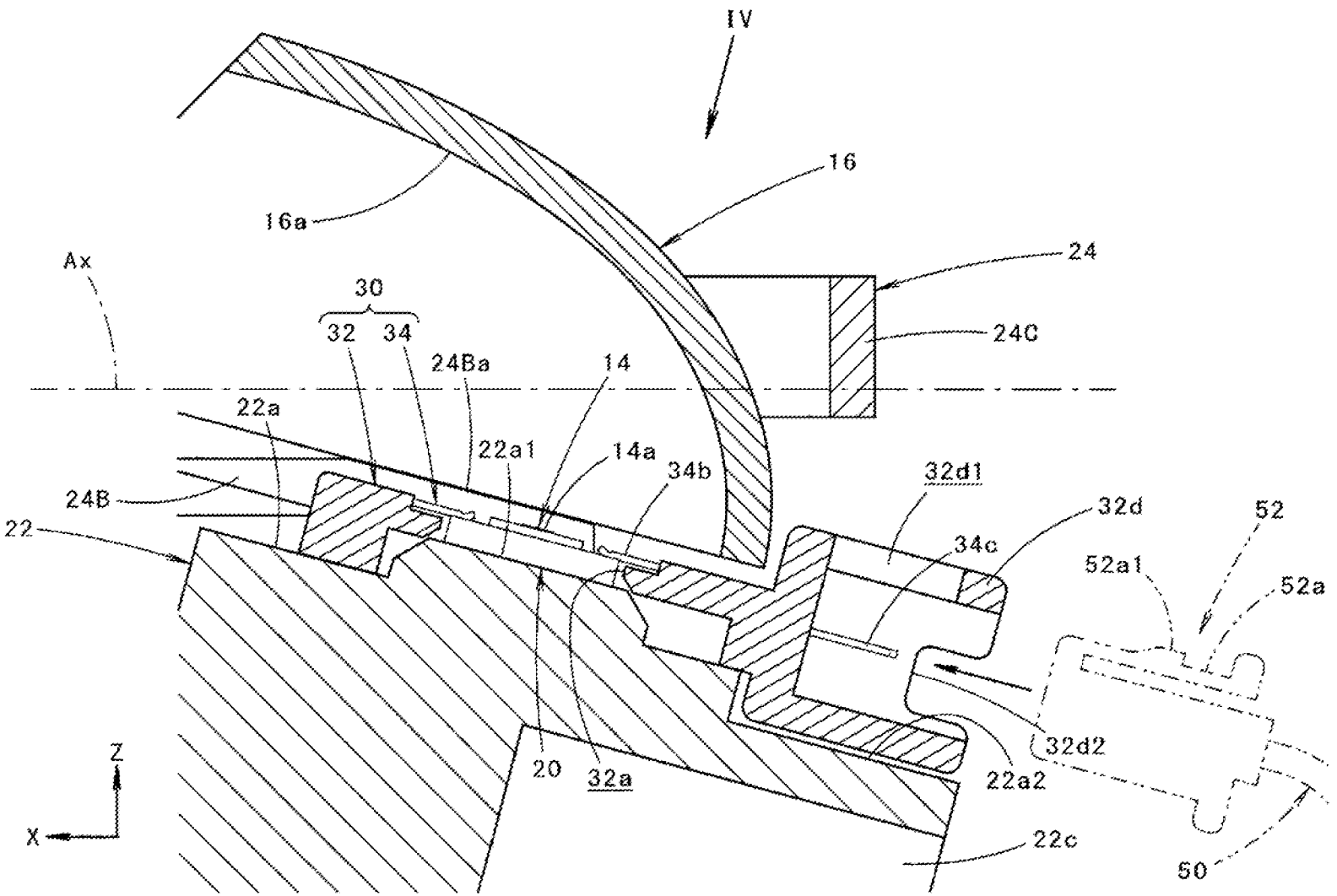
FIG. 3 is a detailed view of Part III of FIG. 1.
Figure 4:
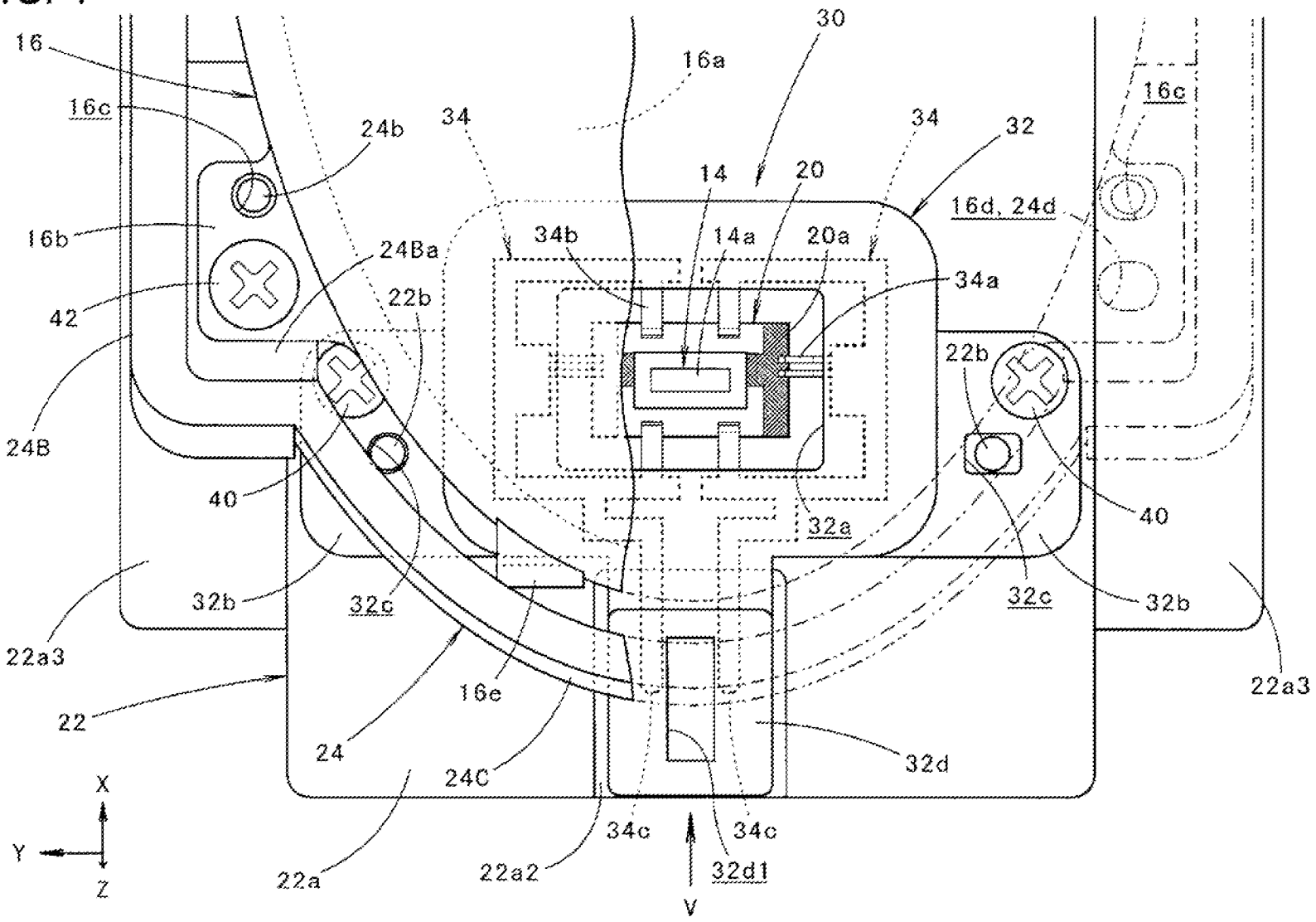
FIG. 4 is a view in a direction of an arrow IV in FIG. 3.
Figure 5:
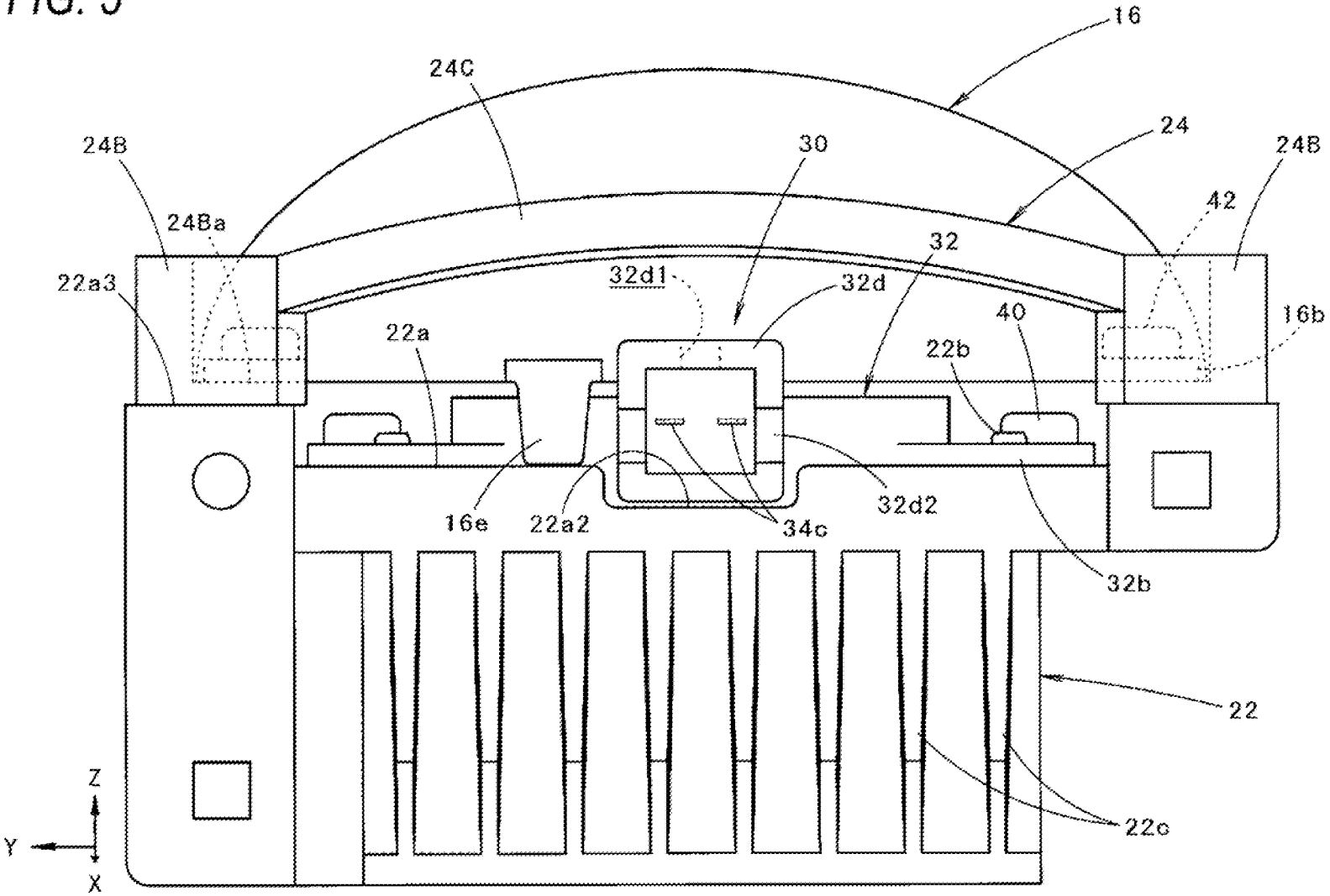
FIG. 5 is a view in a direction of an arrow V in FIG. 4.

FIG. 3 is a detailed view of Part III of FIG. 1. FIG. 4 is a view in a direction of an arrow IV in FIG. 3. FIG. 5 is a view in a direction of an arrow V in FIG. 4.

As illustrated in FIG. 3, the light emitting element 14 is a white light emitting diode, and has a light emitting surface 14*a* having a horizontally long rectangular shape. The light emitting element 14 is supported by a heat sink 22 via a light source supporting member 20 in a state where the light emitting surface 14*a* faces upward below the light axis Ax.

On an upper surface 22*a* of the heat sink 22, a light source support region 22*a*1 on which the light source supporting member 20 is supported is formed in a planar shape in a state of protruding upward with respect to a peripheral region thereof. The light source support region 22*a*1 is formed by an inclined surface that is inclined downward toward a unit rear together with the peripheral region thereof. Therefore, the light emitting surface 14*a* of the light emitting element 14 is disposed in a state in which the light emitting surface 14*a* faces obliquely upward and rearward.

The power supply attachment 30 for supplying power to the light emitting element 14 is attached to the upper surface 22*a* of the heat sink 22 (this will be described later).

The reflector 16 includes a reflecting surface 16*a* having a curved surface having a substantially elliptical surface shape with a light emitting center of the light emitting element 14 as a first focus point. The reflecting surface 16*a* is set to an elliptical shape having a point whose vertical cross-sectional shape along a long axis thereof is positioned slightly in front of the rear side focus point F as a second focus point. An eccentricity of the reflecting surface 16*a* is set to gradually increase from a vertical cross section of the reflecting surface 16*a* to a horizontal cross section of the reflecting surface 16*a*. The reflector 16 is supported by the heat sink 22 at both left and right side portions of the reflector 16 (this will also be described later).

On the other hand, as illustrated in FIGS. 1 and 2, the projection lens 12 is supported by a lens holder 24 at an outer peripheral flange portion thereof.

The lens holder 24 includes a holder body 24A that supports the projection lens 12, a pair of left and right arm portions 24B that are formed so as to extend from both left and right side portions of the holder body 24A toward the unit rear, and a connecting portion 24C that connects rear end portions of the pair of left and right arm portions 24B. The pair of left and right arm portions 24B are formed so as to be bent toward a light axis Ax side at the rear end portions thereof. The connecting portion 24C is formed so as to surround the reflector 16 in a substantially arc shape. The lens holder 24 is attached to the heat sink 22 at a portion near the rear end portions of the pair of left and right arm portions 24B thereof (this will also be described later).

As illustrated in FIG. 1, the movable shade 18 is rotatably supported by the heat sink 22 via a rotation pin 26 extending in a left-right direction below the light axis Ax. The movable shade 18 is formed so as to extend obliquely upward from a front end portion of the movable shade 18 toward the unit rear. An upper end edge 18*a* of the movable shade 18 is formed so as to extend in a horizontal direction with a difference between left and right steps.

The movable shade 18 can adopt a light shielding position (a position indicated by a solid line in FIG. 1) in which a part of reflective light from the reflector 16 toward the projection lens 12 is shielded by a driving of an actuator 28 supported by the heat sink 22, and a light shielding release position (a position indicated by a two-dot chain line in FIG. 1) in which the light shielding is released by rotating a predetermined angle from the light shielding position to a lower side. The actuator 28 is supported by the heat sink 22 by screw fixing. The actuator 28 is driven when an operation of a beam changeover switch (not shown) is performed.

As illustrated in FIG. 4, the light source supporting member 20 supporting the light emitting element 14 having a horizontally long rectangular outer shape in a plan view. A pair of left and right terminal portions 20*a* electrically connected to a cathode electrode and an anode electrode of the light emitting element 14 are disposed at positions on left and right sides of the light emitting element 14 on an upper surface of the light source supporting member 20.

The power supply attachment 30 is formed as an insert molded product embedded in an insulating member 32 formed so as to surround the light source supporting member 20. At this time, a part of each of a pair of left and right bus bar electrodes 34 for electrically conducting with the light emitting element 14 is exposed.

The insulating member 32 is a plate-shaped member having a horizontally long rectangular outer shape in the plan view. An opening 32*a* having a horizontally long rectangular shape is formed at a center position of the insulating member 32 in the left-right direction.

The insulating member 32 includes a pair of left and right flange portions 32*b* protruding in the horizontal direction from both left and right side portions of the insulating member 32. The insulating member 32 is fixed to the upper surface 22*a* of the heat sink 22 by tightening screws 40 at each flange portion 32*b*. A pair of left and right positioning pins 22*b* are formed on the upper surface 22*a* of the heat sink 22. The pair of left and right flange portions 32*b* of the insulating member 32 are formed with engagement holes 32*c* that engage with the pair of left and right positioning pins 22*b*. One of the pair of left and right engagement holes 32*c* is formed in a circular shape, and the other is formed in a horizontally long rectangular shape.

The pair of left and right bus bar electrodes 34 include two pairs of left and right terminal pieces 34*a* protruding into the opening 32*a*. The two pairs of left and right terminal pieces 34*a* are electrically connected to a light emitting diode 14 by coming into contact with the pair of left and right terminal portions 20*a* of the light source supporting member 20.

The pair of left and right bus bar electrodes 34 also include two pairs of front and rear pressing pieces 34*b* protruding into the opening 32*a*. The two pairs of front and rear pressing pieces 34*b* are in contact with the upper surface of the light source supporting member 20, so that the light emitting diode 14 does not float from the heat sink 22 due to vibration or the like.

In this case, each terminal piece 34*a* and each pressing piece 34*b* function as an elastic piece that elastically presses the light source supporting member 20 from an upper side.

The insulating member 32 includes a connector portion 32*d* protruding toward the unit rear from a rear portion of the insulating member 32.

The connector portion 32*d* is formed so as to extend to the unit rear side relative to a rear end position of the reflector 16, and opens toward the unit rear. As illustrated in FIG. 3, the connector portion 32*d* is formed at a center position of two left and right fastening positions of the insulating member 32 and the heat sink 22 (that is, a position directly below the light axis Ax). The connector portion 32*d* is formed so as to protrude to both upper and lower sides on the unit rear side relative to the rear end position of the reflector 16.

A rectangular hole 32*d*1 extending in the unit front-rear direction is formed in an upper wall portion of the connector portion 32*d*. A rectangular recessed portion 32*d*2 is formed in both left and right side wall portions of the connector portion 32*d* (see FIG. 5).

As illustrated in FIGS. 3 to 5, terminal pins 34*c* of the pair of left and right bus bar electrodes 34 protrude toward the unit rear in the internal space of the connector portion 32*d*. Each of the pair of left and right terminal pins 34*c* is formed in a plate shape, a plate surface thereof faces an up-down direction (that is, a second direction orthogonal to a first direction in which the pair of left and right terminal pins 34*c* are disposed side by side) inclined to the unit rear side with respect to a vertical direction. As illustrated in FIG. 3, a connector 52 of a power supply wiring 50 is inserted into the internal space of the connector portion 32*d* from the unit rear side. The power supply attachment 30 and the power supply wiring are electrically connected by fitting the connector of the power supply wiring into the rectangular hole 32*d*1 and the pair of left and right recessed portions 32*d*2 of the connector portion 32*d*.

An elastic arm 52*a* extending toward the unit rear is formed in an upper portion of the connector 52. A lance portion 52*a*1 is formed on an upper surface of the elastic arm 52*a*. When the connector 52 is inserted into the internal space of the connector portion 32*d*, the elastic arm 52*a* is bent and deformed, so that the lance portion 52*a*1 is engaged with the rectangular hole 32*d*1 of the connector portion 32*d*. Accordingly, a fitting state of the two parts is maintained.

As illustrated in FIG. 3, a rear end position of the heat sink 22 is substantially the same as a position of a rear end edge of the connector portion 32*d*. A recessed portion 22*a*2 having a shape conforming to a shape of a lower end portion of the connector portion 32*d* is formed on the upper surface 22*a* of a rear end portion of the heat sink 22 (that is, a surface on which the power supply attachment 30 is placed). Further, in a rear region of the heat sink 22, a plurality of heat dissipation fins 22*c* are formed so as to extend downward (see FIG. 5).

As illustrated in FIG. 4, the reflector 16 includes a pair of left and right flange portions 16*b* protruding in a flat plate shape in the horizontal direction from lower end positions of both left and right side portions of the reflector 16. The reflector 16 is fixed to the upper surface 22*a* of the heat sink 22 together with the lens holder 24 by tightening screws 42 in the respective flange portions 16*b*.

As illustrated in FIG. 5, a portion of the upper surface 22*a* of the heat sink 22 to which the reflector 16 is attached is formed as a pair of left and right upper protruding surfaces 22*a*3 protruding upward relative to other portions of the upper surface 22*a*. A pair of left and right placement surfaces 24Ba for placing the pair of left and right flange portions 16*b* of the reflector 16 are formed near the rear end portions of the pair of left and right arm portions 24B in the lens holder 24 (see FIG. 2). As illustrated in FIG. 3, the pair of left and right placement surfaces 24Ba are formed as inclined surfaces that are inclined downward toward the unit rear. An inclination angle of the pair of left and right placement surfaces 24Ba is set to the same value as an inclination angle of the upper surface 22*a* (including the pair of left and right upper protruding surfaces 22*a*3) of the heat sink 22.

As illustrated in FIGS. 2 and 4, a pair of left and right positioning pins 24*b* are formed on the pair of left and right placement surfaces 24Ba. On the other hand, the pair of left and right flange portions 16*b* of the reflector 16 are respectively formed with engagement holes 16*c* that engage with the pair of left and right positioning pins 24*b*. One of the pair of left and right engagement holes 16*c* is formed in a circular shape, and the other is formed in a horizontally oval shape (see FIG. 4).

As illustrated in FIG. 4, a pair of left and right screw insertion holes 16*d* are formed in the pair of left and right flange portions 16*b* of the reflector 16. A pair of left and right screw insertion holes 24*d* are formed in the pair of left and right placement surfaces 24Ba of the lens holder 24. One of the screw insertion holes 16*d* and the screw insertion holes 24*d* are formed in a circular shape, and the other are formed in a horizontally oval shape.

Two left and right fastening positions of the reflector 16 are set at positions close to a rear end portion of the reflector 16. Specifically, positions of the screw insertion holes 16*d* formed in the pair of left and right flange portions 16*b* are set to positions overlapping the opening 32*a* of the insulating member 32 in the unit front-rear direction. Therefore, the pair of left and right screw insertion holes 16*d* and the opening 32*a* partially overlap with each other in the unit front-rear direction.

As described above, since the reflecting surface 16*a* of the reflector 16 has a curved surface having a substantially elliptical surface shape, as illustrated in FIG. 3, an interval between the lower end positions of both the left and right side portions of the reflector 16 is narrowed in the left-right direction toward the unit rear. Therefore, since the two left and right fastening positions of the reflector 16 are set at positions close to the rear end portion of the reflector 16, an interval between the pair of left and right flange portions 16*b* is relatively narrow.

As illustrated in FIGS. 4 and 5, the reflector 16 is provided with a contact portion 16*e* that is in contact with the heat sink 22 at a portion of the reflector 16 that is positioned on the unit rear side relative to the two left and right fastening positions with respect to the heat sink 22. At a position near a left side of the recessed portion 22*a*2 of the heat sink 22, the contact portion 16*e* is formed as a protruding portion extending to the unit rear from the lower end portion of the reflector 16 and then extending downward, and the contact portion 16*e* is formed to come into contact with the upper surface 22*a* of the heat sink 22. Since a support of the reflector 16 by the heat sink 22 is performed by a three-point support structure, a positioning accuracy of the reflector 16 is improved.

As illustrated in FIG. 2, contact portions 22*d*, which are in contact with the lens holder 24, are formed at front end portions of the pair of left and right upper protruding surfaces 22*a*3 on the upper surface 22*a* of the heat sink 22.

As illustrated in FIGS. 1 and 2, the pair of left and right contact portions 22*d* are formed as protruding portions that extend upward. The pair of left and right contact portions 22*d* are formed to be into contact with lower surfaces of the pair of left and right arm portions 24B of the lens holder 24.

Next, an operation of the present embodiment will be described.

The lamp unit 10 according to the present embodiment has a configuration in which the power supply attachment 30 is attached to the heat sink 22 that supports the light emitting element 14 and the reflector 16. The power supply attachment 30 is fastened to the heat sink 22 at two left and right positions of the power supply attachment 30. The connector portion 32*d* of the power supply attachment 30 is formed inside the two left and right fastening positions so as to extend to the unit rear side relative to the rear end position of the reflector 16, so that a following effect can be obtained.

That is, according to the lamp unit 10, a left-right width dimension of the power supply attachment 30 can be made smaller than in a case where the connector portion 32*d* is formed at an end portion of the power supply attachment 30 in the left-right direction. As a result, since it is possible to easily support the reflector 16 with respect to the heat sink 22 without interfering with the connector portion 32*d* of the power supply attachment 30, the left-right width dimension of the lamp unit 10 can be reduced.

In addition, since the connector portion 32*d* of the power supply attachment 30 is formed so as to extend to the unit rear side relative to the rear end position of the reflector 16, it is possible to easily perform connection work between the power supply attachment 30 and the connector of the power supply wiring by using a rear space of the reflector.

Thus, according to the present embodiment, in the lamp unit 10 in which the light emitting element 14 and the reflector 16 are supported by the heat sink 22, even when the power supply attachment 30 is attached to the heat sink 22, the connector of the power supply wiring can be easily connected to the power supply attachment 30 while reducing the left-right width dimension of the lamp unit 10.

As in the present embodiment, the connector portion 32*d* of the power supply attachment 30 is formed so as to extend to the unit rear side relative to the rear end position of the reflector 16, so that when the connector of the power supply wiring is connected to the power supply attachment 30, the connection work can be performed in a state in which the connector portion 32*d* of the power supply attachment 30 is pressed. Therefore, it is possible to prevent a position of the reflector 16 from being displaced from a desired position due to the reflector 16 being inadvertently pressed during the connection work.

At this time, in the present embodiment, since the connector portion 32*d* of the power supply attachment 30 is formed so as to open toward the unit rear, it is possible to more easily perform the connection work of the connector of the power supply wiring.

In the present embodiment, since the connector portion 32*d* of the power supply attachment 30 is formed so as to protrude to both the upper and lower sides on the unit rear side relative to the rear end position of the reflector 16 (that is, also, so as to protrude toward a reflector 16 side), a following effect can be obtained.

That is, when the connector portion 32*d* of the power supply attachment 30 is positioned inside the above two left and right fastening positions, it is necessary to form the recessed portion 22*a*2 in the heat sink 22 for avoiding interference with the connector portion 32*d*. On the other hand, since a portion positioned inside the above two left and right fastening positions in the heat sink 22 is close to the light emitting element 14, it is highly necessary to dissipate heat generated by lighting of the light emitting element 14. Therefore, the connector portion 32*d* of the power supply attachment 30 is formed so as to protrude toward the reflector 16 side on the unit rear side relative to the rear end position of the reflector 16, so that it is possible to make the recessed portion 22*a*2 formed on the upper surface 22*a* of the heat sink 22 shallow in order to avoid interference with the connector portion 32*d*. Accordingly, by disposing the connector portion 32*d* inside the above two left and right fastening positions, it is possible to effectively prevent a heat dissipation function of the heat sink 22 from being lowered.

Further, in the present embodiment, since the connector portion 32*d* of the power supply attachment 30 is formed at a center position of the two left and right fastening positions, even in a case where the pair of left and right lamp units 10 are used as in the vehicle lamp 100 according to the present embodiment, the power supply attachment 30 can be easily shared between the two lamp units 10.

In the present embodiment, the reflector 16 is fastened to the heat sink 22 at two left and right positions of the reflector 16, and the contact portion 16*e* that is in contact with the heat sink 22 is formed at the portion of the reflector 16 positioned on the unit rear side relative to the two left and right fastening positions of the reflector 16. Therefore, the support of the reflector 16 by the heat sink 22 can be performed by the three-point support structure, so that the positioning accuracy of the reflector 16 can be improved.

Further, in the present embodiment, since the contact portions 22*d*, which are in contact with the lens holder 24, are formed at the front end portions of the pair of left and right upper protruding surfaces 22*a*3 on the upper surface 22*a* of the heat sink 22, a support of the lens holder 24 by the heat sink 22 can be performed at four positions, and accordingly, a positioning accuracy of the projection lens 12 can be improved.

In the present embodiment, the light emitting element 14 is mounted on the upper surface 22*a* of the heat sink 22, and on the upper surface 22*a*, the light source support region 22*a*1 on which the light emitting element 14 is mounted is formed by the inclined surface inclined downward toward the unit rear together with the peripheral region thereof. Therefore, it is possible to shorten a front-rear length of the lamp unit 10 by the inclination thereof. By adopting such a configuration, it is possible to increase an efficiency of incidence of light emitted from the light emitting element 14 into the reflector 16.

Further, in the present embodiment, the lens holder 24 is formed in a closed frame shape by the holder body 24A, the pair of left and right arm portions 248, and the connecting portion 24C. Therefore, it is possible to increase a rigidity of the lens holder 24, and accordingly, it is possible to improve a positional relationship accuracy of the pair of left and right screw insertion holes 24*d*.

The lamp unit 10 according to the present embodiment has a configuration in which the power supply attachment 30 is attached to the heat sink 22 that supports the light emitting element 14 and the reflector 16, and at that time, the reflector 16 is fastened to the heat sink 22 at the two left and right positions of the reflector 16, and the connector portion 32*d* of the insulating member 32 of the power supply attachment 30 is positioned inside the two left and right fastening positions of the reflector 16. Therefore, the left-right width dimension of the power supply attachment 30 can be made smaller than in the case where the connector portion 32*d* is positioned at the end portion of the power supply attachment 30 in the left-right direction as in the related art. Therefore, it is possible to easily support the reflector 16 with respect to the heat sink 22 without interfering with the connector portion 32*d* of the power supply attachment 30, and accordingly, the left-right width dimension of the lamp unit 10 can be reduced.

In addition, in the lamp unit 10 according to the present embodiment, the two left and right fastening positions of the reflector 16 are set to positions overlapping the opening 32*a* of the power supply attachment 30 with respect to the unit front-rear direction. Therefore, as a configuration of the reflector 16, a left-right width dimension of the entire reflector 16 including the pair of left and right flange portions 16*b* can be reduced, and accordingly, the left-right width dimension of the lamp unit 10 can be further reduced.

Thus, according to the present embodiment, in the lamp unit 10 in which the light emitting element and the reflector 16 are supported by the heat sink 22, even when the power supply attachment 30 is attached to the heat sink 22, the left-right width dimension of the lamp unit 10 can be reduced.

In the present embodiment, the power supply attachment 30 is fastened to the heat sink 22 at two left and right positions of the power supply attachment 30. In addition, the two left and right fastening positions of the reflector 16 are set on a unit front side relative to two left and right fastening positions of the power supply attachment 30. Therefore, the power supply attachment 30 can be fastened to the heat sink 22 without interfering with the fastening portion of the reflector 16 to the heat sink 22.

In the present embodiment, as the reflector 16, the contact portion 16*e* (first contact portion) that is in contact with the heat sink 22 is provided at the portion positioned on the unit rear side relative to the two left and right fastening positions of the reflector 16. As a result, the support of the reflector 16 by the heat sink 22 can be performed by the three-point support structure, so that the positioning accuracy of the reflector 16 can be improved.

Further, in the present embodiment, the lamp unit 10 includes the projection lens 12 that allows reflective light from the reflector 16 to be incident on the unit front side relative to the light emitting element 14, and the lens holder 24 that supports the projection lens 12, in which as the reflector 16, the second contact portion 22*d* (second contact portion) that is in contact with the lens holder 24 is provided at the portion positioned on the unit front side relative to the two left and right fastening positions the reflector 16, so that it is possible to further improve the positioning accuracy of the reflector 16.

In the present embodiment, the light emitting element 14 is mounted on the upper surface 22*a* of the heat sink 22, and on the upper surface 22*a*, the light source support region 22*a*1 on which the light emitting element 14 is mounted is formed by the inclined surface inclined downward toward the unit rear together with the peripheral region thereof. Therefore, it is possible to shorten the front-rear length of the lamp unit 10 by the inclination thereof. By adopting such a configuration, it is possible to increase an efficiency of incidence of light emitted from the light emitting element 14 into the reflector 16.

In the power supply attachment 30 according to the present embodiment, the terminal piece 34*a* (first terminal portion) electrically connected to the light emitting element 14 and the terminal pin 34*c* (second terminal portion) electrically connected to the external power source are formed by an exposed portion of the pair of left and right bus bar electrodes 34 embedded in the insulating member 32 from the insulating member 32. The opening 32*a* that exposes the pair of terminal pieces 34*a* and the connector portion 32*d* that accommodates the pair of terminal pins 34*c* are formed in the insulating member 32. On the other hand, the pair of terminal pins 34*c* are disposed side by side in the horizontal direction in the internal space of the connector portion 32*d*. Therefore, a dimension of the connector portion 32*d* in the up-down direction can be reduced, thereby making it possible to reduce a thickness of the power supply attachment 30.

Thus, according to the present embodiment, it is possible to reduce the thickness of the power supply attachment 30 for supplying power to the light emitting element 14.

At this time, in the power supply attachment 30 according to the present embodiment, the connector portion 32*d* of the insulating member 32 is formed at a position overlapping the opening 32*a* of the insulating member 32 (specifically, a center position in the opening 32*a* in the left-right direction) with respect to the left-right direction (that is, in the first direction in which the pair of terminal pins 34*c* are disposed side by side). Therefore, even in a case where the power supply attachment 30 is used in the pair of left and right lamp units 10 as in the vehicle lamp 100 according to the present embodiment, the power supply attachment 30 can be easily shared between the two lamp units 10.

Each of the terminal pins 34*c* of the pair of left and right bus bar electrodes 34 is formed in a plate shape, the plate surface thereof faces the up-down direction (that is, the second direction orthogonal to the first direction) inclined to the unit rear side with respect to the vertical direction. Therefore, the dimension of the connector portion 32*d* in the up-down direction can be further reduced, thereby making it possible to further reduce the thickness of the power supply attachment 30.

In the lamp unit 10 according to the present embodiment, the power supply attachment 30 and the light emitting element 14 are supported by the heat sink 22 together with the reflector 16 (optical member) that controls the light emitted from the light emitting element 14, and the recessed portion 22*a*2 that accommodates at least a portion of the connector portion 32*d* in the insulating member 32 of the power supply attachment 30 is formed on the upper surface 22*a* of the heat sink 22 (that is, the surface on which the power supply attachment 30 is placed). By forming the recessed portion 22*a*2 on the upper surface 22*a* of the heat sink 22, it is possible to easily avoid interference with the connector portion 32*d*, and since the dimension of the connector portion 32*d* in the up-down direction thereof is small, by forming the recessed portion 22*a*2 on the upper surface 22*a* of the heat sink 22, it is possible to effectively prevent the heat dissipation function of the heat sink 22 from being lowered.

The rectangular hole 32*d*1 (engagement hole) for engaging the connector portion 32*d* with the connector on an external power source side is formed in the upper wall portion of the connector portion 32*d*. Therefore, by engaging the connector portion 32*d* with the connector 52 on the external power source side in the rectangular hole 32*d*1, it is possible to easily maintain an electrical connection between the power supply attachment 30 and the external power source due to the fitting between the connector portion 32*d* and the connector 52 on the external power source side, and it is possible to visually check the fitting state thereof in the engagement hole 32*d*1 of the connector portion 32*d*.

Next, modifications of the above embodiment will be described. In the following description, the same elements as those of the above embodiment are denoted by the same reference signs, and a repeated description thereof is omitted.

First, a first modification of the above embodiment will be described.

Figure 6:
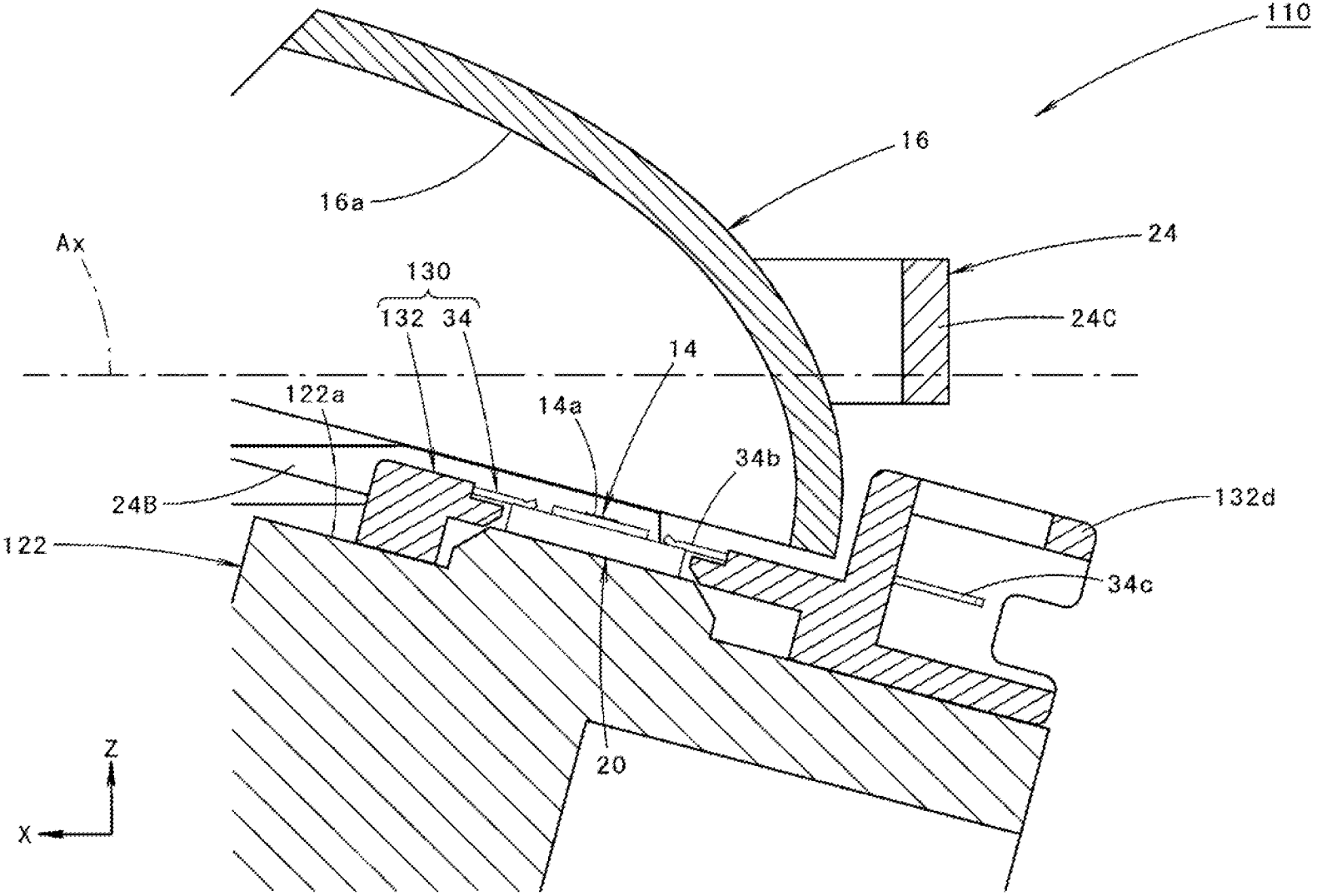
FIG. 6 is a diagram illustrating a first modification.

FIG. 6 is a view illustrating main parts of a lamp unit 110 according to a present modification.

As illustrated in FIG. 6, a basic configuration of the present modification is similar as that of the above embodiment, but in the present modification, a configuration of a power supply attachment 130 is partially different from that of the above embodiment.

That is, also in the power supply attachment 130 of the present modification, a connector portion 132*d* of an insulating member 132 is formed so as to extend to the unit rear side relative to the rear end position of the reflector 16, but the connector portion 132*d* is formed so as to protrude only upward on the unit rear side relative to the rear end position of the reflector 16 (that is, so as to protrude only toward the reflector 16 side).

Therefore, an upper surface 122*a* of a heat sink 122 is not provided with the recessed portion 22*a*2 that is formed to avoid interference with the connector portion 32*d* in the heat sink 22 of the above embodiment.

By adopting a configuration of the present modification, even though the connector portion 132*d* is disposed inside the two left and right fastening positions of the power supply attachment 130 and the heat sink 122, it is possible to more effectively prevent the heat dissipation function of the heat sink 122 from being lowered.

Next, a second modification of the above embodiment will be described.

Figure 7:
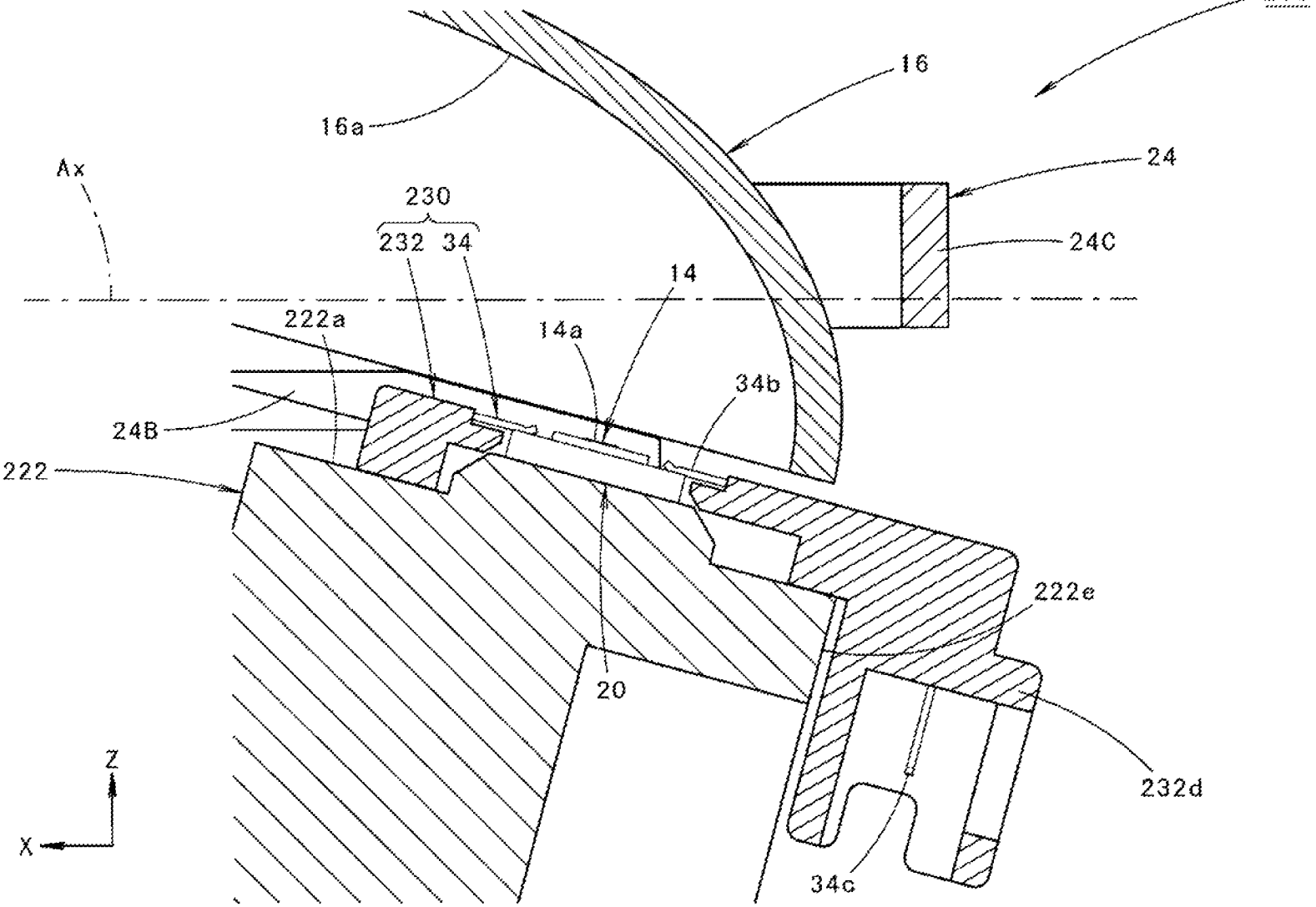
FIG. 7 is a diagram illustrating a second modification.

FIG. 7 is a view illustrating main parts of a lamp unit 210 according to a present modification.

As illustrated in FIG. 7, a basic configuration of the present modification is similar as that of the above embodiment, but in the present modification, a configuration of a power supply attachment 230 is partially different from that of the above embodiment.

That is, also in a power supply attachment 230 of the present modification, a connector portion 232*d* of an insulating member 232 thereof is formed so as to extend to the unit rear side relative to the rear end position of the reflector 16, but the connector portion 232*d* is formed to open downward.

Therefore, a cutout portion 222*e* for avoiding interference with the connector portion 232*d* is formed in a rear portion of a heat sink 222.

By adopting a configuration of the present modification, the connection work between the connector of the power supply wiring and the connector portion 232*d* of the power supply attachment 230 is performed from a lower side, and thus a space for performing the connection work can be easily secured in the housing.

Next, a third modification of the above embodiment will be described.

Figure 8:
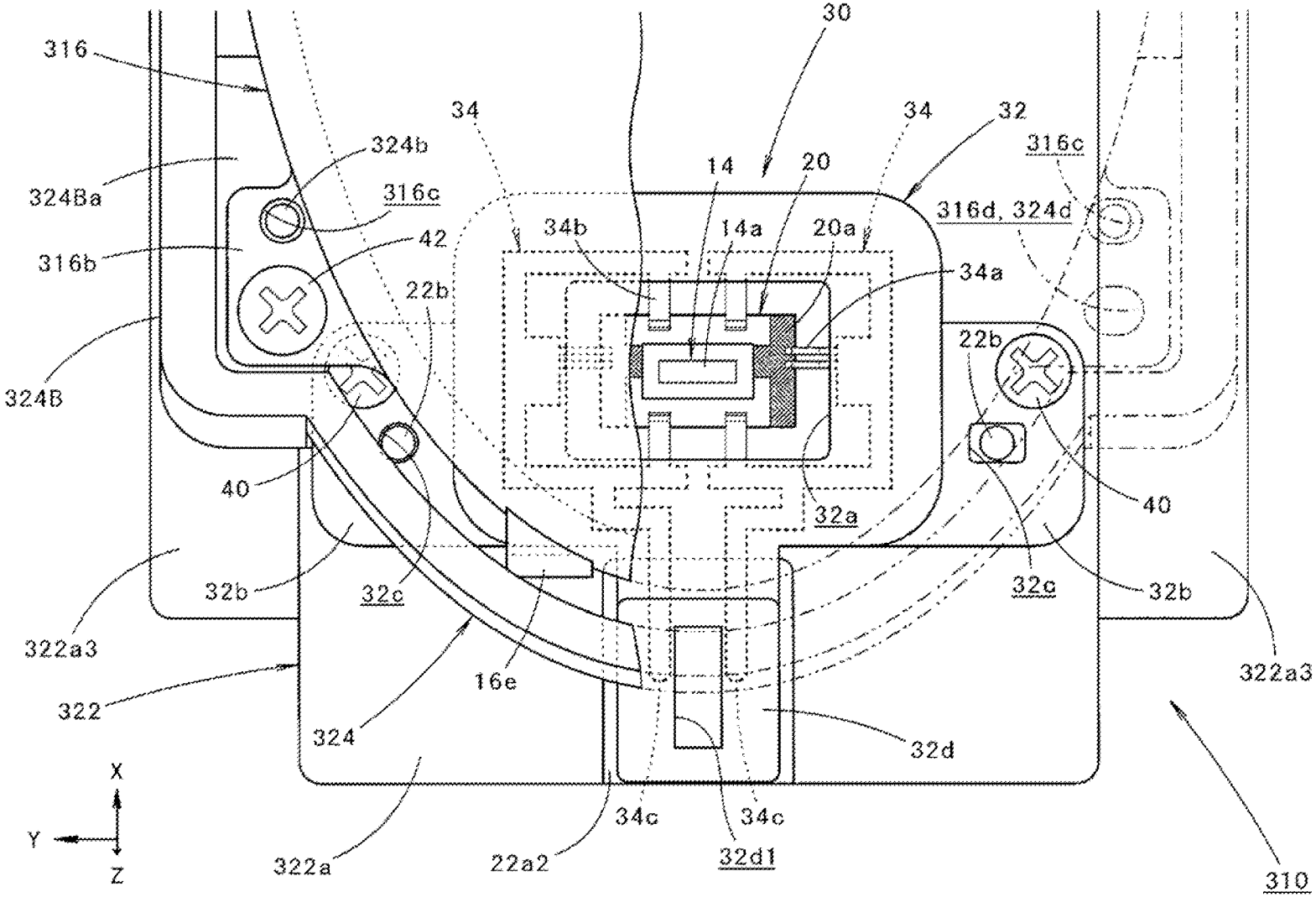
FIG. 8 is a diagram illustrating a third modification of the above embodiment.

FIG. 8 is a view illustrating main parts of a lamp unit 310 according to a present modification.

As illustrated in FIG. 8, a basic configuration of the present modification is similar as that of the above embodiment, but in the present modification, an arrangement of a pair of left and right flange portions 316*b* in a reflector 316 is partially different from that in the above embodiment, and accordingly, configurations of a lens holder 324 and a heat sink 322 are also partially different from those in the above embodiment.

That is, also in the reflector 316 of the present modification, the pair of left and right flange portions 316*b* are formed so as to protrude in the flat plate shape in the horizontal direction from lower end positions of both left and right side portions of the reflector 316, and the reflector 316 is fixed to an upper surface 322*a* of the heat sink 322 together with the lens holder 324 by tightening the screws 42 in the respective flange portions 316*b*, but forming positions of the pair of left and right flange portions 316*b* are set to the unit rear side relative to that in the case of the above embodiment.

Specifically, also in the present modification, positions of screw insertion holes 316*d* formed in the pair of left and right flange portions 316*b* are set to positions overlapping the opening 32*a* of the insulating member 32 in the unit front-rear direction, but in the present modification, the pair of left and right screw insertion holes 316*d* and the opening 32*a* of the insulating member 32 completely overlap with each other in the unit front-rear direction.

An interval between the lower end positions of both the left and right side portions of the reflector 316 is narrowed in the left-right direction toward the unit rear, so that an interval between the pair of left and right flange portions 316*b* is also narrower than in the case of the above embodiment.

Accordingly, positions of the pair of left and right screw insertion holes 316*d* formed in the pair of left and right flange portions 316*b* of the reflector 316 are displaced in a direction closer to a center in the left-right direction than that in the case of the above embodiment. Positions of a pair of left and right screw insertion holes 324*d* formed in a pair of left and right placement surface 324Ba of the lens holder 324 are also displaced in the direction closer to the center in the left-right direction than that in the case of the above embodiment.

Similarly, positions of a pair of left and right positioning pins 324*b* formed on the pair of left and right placement surfaces 324Ba and positions of the engagement holes 316*c* with which the pair of left and right positioning pins 324*b* formed on the pair of left and right flange portions 316*b* engages are also displaced in the direction closer to the center in the left-right direction than that in the case of the above embodiment.

Further, as the pair of left and right flange portions 316*b* are displaced in the direction closer to the center in the left-right direction, positions of a pair of left and right arm portions 324B of the lens holder 324 and positions of outer surfaces of a pair of left and right upper protruding surfaces 322*a*3 of the heat sink 322 are displaced in the direction closer to the center in the left-right direction than that in the case of the above embodiment.

Even when the configuration of the present modification is adopted, substantially similar effects as those in the above embodiment can be obtained.

By adopting the configuration of the present modification, a left-right width dimension of the lamp unit 310 can be further reduced as compared with that in the case of the above embodiment.

Next, a fourth modification of the above embodiment will be described.

Figure 9:
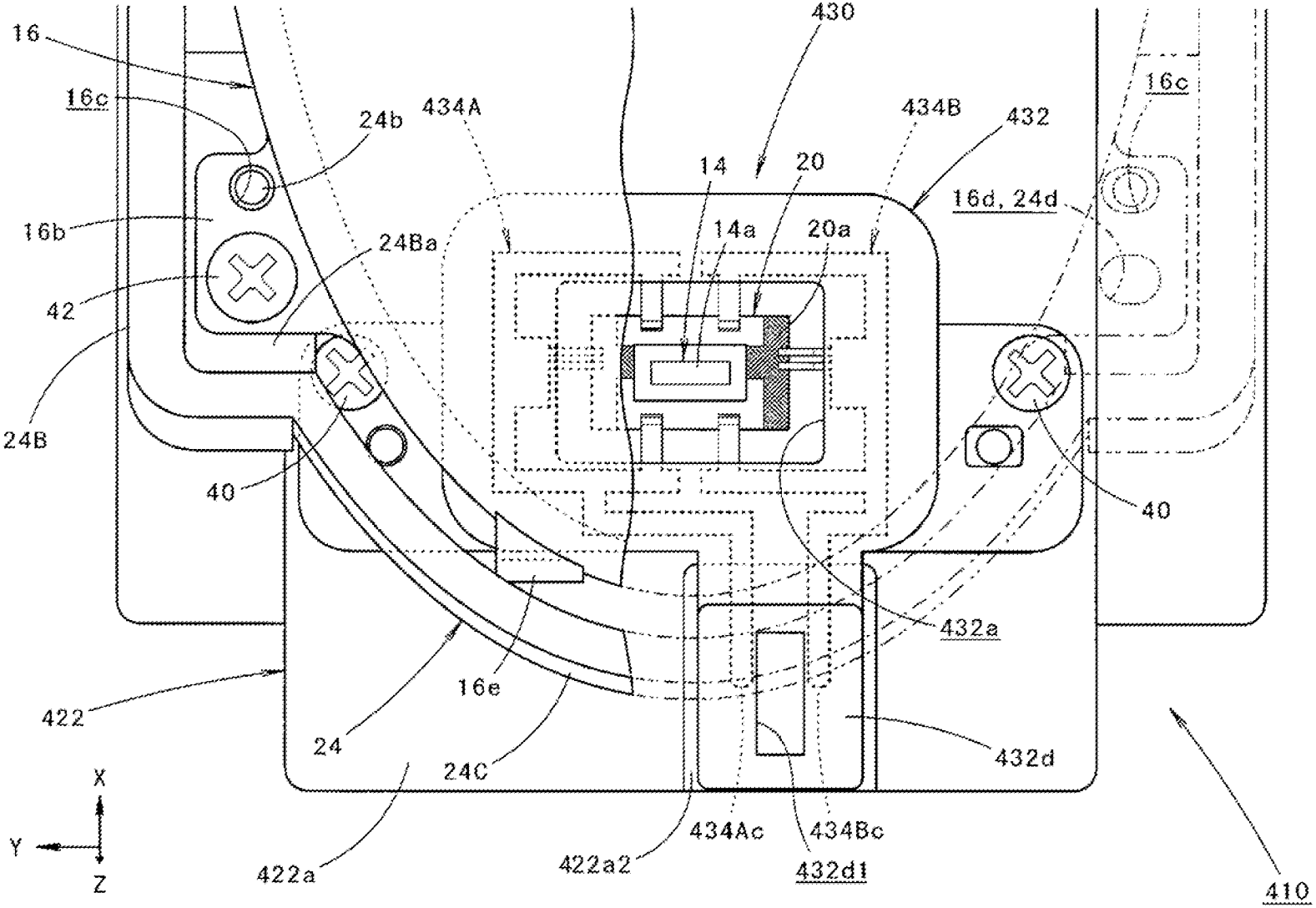
FIG. 9 is a diagram illustrating a fourth modification of the above embodiment.

FIG. 9 is a view illustrating main parts of a lamp unit 410 according to a present modification.

As illustrated in FIG. 9, a basic configuration of the present modification is similar as that of the above embodiment, but in the present modification, a configuration of a power supply attachment 430 is partially different from that of the above embodiment, and accordingly, a configuration of a heat sink 422 is also partially different from that of the above embodiment.

That is, also in the power supply attachment 430 of the present modification, a connector portion 432*d* of an insulating member 432 is formed at a position overlapping an opening 432*a* of the insulating member 432 in the left-right direction (that is, in a direction in which a pair of terminal pins 434Ac and 434Bc are disposed side by side), but a forming position of the connector portion 432*d* is set to a position displaced to a right direction from a center position of the opening 432*a* in the left-right direction. Therefore, the connector portion 432*d* and the opening 432*a* partially overlap with each other in the left-right direction.

Accordingly, a pair of left and right bus bar electrodes 434A and 434B are formed at positions where the terminal pins 434Ac and 434Bc thereof are displaced to the right direction from the center position of the opening 432*a*.

Further, a recessed portion 422*a*2 having a shape conforming to a shape of a lower end portion of the connector portion 432*d* formed on an upper surface 422*a* of a rear end portion of the heat sink 422 is also displaced to the right direction from the center position of the opening 432*a*.

In the present modification, a shape itself of the connector portion 432*d* is similar as that in the above embodiment. A rectangular hole 432*d*1 extending in the unit front-rear direction is formed in an upper wall portion of the connector portion 432*d*.

Even when the configuration of the present modification is adopted, since the connector portion 432*d* of the insulating member 432 is formed at a position overlapping the opening 432*a* in the left-right direction, substantially similar effects as those in the above embodiment can be obtained.

By adopting the configuration in which the forming position of the connector portion 432*d* of the insulating member 432 is displaced to the right direction from the center position of the opening 432*a* as in the power supply attachment 430 according to the present modification, a position of the contact portion 16*e* formed on the reflector 16 can be further displaced to the unit rear side. Accordingly, a support of the reflector 16 by the heat sink 422 can be performed with a more stable three-point support structure.

Of course, numerical values shown as the specifications in the above embodiment and the modifications thereof are merely examples, and these may be set to different values as appropriate.

In addition, the present disclosure is not limited to the configurations described in the above embodiment and modifications thereof, and a configuration in which various other modifications are added can be adopted.

In the above embodiment, it is described that the entire connector portion 32*d* of the power supply attachment 30 is positioned on the unit rear side relative to the rear end position of the reflector 16, but only a portion of the connector portion 32*d* may be positioned on the unit rear side relative to the rear end position of the reflector 16.

In the above embodiment, it is described that the connector portion 32*d* of the insulating member 32 of the power supply attachment 30 is formed at the center position of the opening 32*a* in the left-right direction, but the connector portion 32*d* of the insulating member 32 of the power supply attachment 30 may be formed at a position displaced from the center position of the opening 32*a* in the left-right direction as long as the connector portion 32*d* is positioned inside the two left and right fastening positions of the reflector 16.

In the above embodiment, it is described that in the connector portion 32*d* of the insulating member 32 of the power supply attachment 30, the rectangular hole 32*d*1 is formed as the engagement hole for engaging the connector portion 32*d* with the connector 52 on the external power source side, but an engagement hole having an opening shape other than a rectangle (for example, an oval shape) may be formed.

In the above embodiment, it is described that the lamp unit 10 is a projector-type lamp unit provided with the reflector 16, but the lamp unit 10 may be a paraboloidal reflector-type lamp unit.

In the above embodiment, the lamp unit 10 is described as being a vehicular lamp unit, but the lamp unit 10 may be used for other applications other than vehicular use.

The present application is based on Japanese patent application filed on May 7, 2019, (Japanese Patent Application No. 2019-087819). Japanese patent application filed on May 7, 2019, (Japanese Patent Application No. 2019-087821), and Japanese patent application filed on May 7, 2019, (Japanese Patent Application No. 2019-087822), the contents of which are incorporated herein by reference.

The invention claimed is:

1. A lamp unit comprising:

a light emitting element;

a reflector that reflects light emitted from the light emitting element toward a unit front;

a heat sink that supports the light emitting element and the reflector; and a power supply attachment for supplying power to the light emitting element that is attached to the heat sink and includes a connector portion, wherein the power supply attachment is fastened to the heat sink at two left and right fastening positions of the power supply attachment, and the connector portion of the power supply attachment is formed inside the two left and right fastening positions so as to extend to a unit rear side relative to a rear end position of the reflector.

2. The lamp unit according to claim 1, wherein the connector portion is formed so as to open toward a unit rear.

3. The lamp unit according to claim 1, wherein the connector portion is formed so as to protrude toward a reflector side on the unit rear side relative to the rear end position of the reflector.

4. The lamp unit according to claim 1, wherein the connector portion is formed at a center position of the two left and right fastening positions.

5. The lamp unit according to claim 1, wherein the reflector is fastened to the heat sink at two left and right positions of the reflector, and a contact portion that is in contact with the heat sink is formed at a portion of the reflector positioned on the unit rear side relative to the two left and right fastening positions.

6. The lamp unit according to claim 1, wherein the light emitting element is mounted on an upper surface of the heat sink, and the upper surface of the heat sink is formed by an inclined surface in which a region on which the light emitting element is mounted is inclined downward toward the unit rear.

7. A lamp unit comprising:

a light emitting element;

a reflector that reflects light emitted from the light emitting element toward a unit front;

a heat sink that supports the light emitting element and the reflector; and a power supply attachment for supplying power to the light emitting element that is attached to the heat sink, wherein the reflector is fastened to the heat sink at two left and right positions of the reflector, the power supply attachment includes an opening formed so as to surround the light emitting element, and a connector portion that accommodates a terminal portion electrically connected to an external power source, the connector portion of the power supply attachment is positioned inside two left and right fastening positions of the reflector, and the two left and right fastening positions of the reflector are set to positions overlapping the opening of the power supply attachment with respect to a unit front-rear direction.

8. The lamp unit according to claim 7, wherein the power supply attachment is fastened to the heat sink at two left and right positions of the power supply attachment, and the two left and right fastening positions of the reflector are set on a unit front side relative to two left and right fastening positions of the power supply attachment.

9. The lamp unit according to claim 7, wherein the reflector includes a first contact portion that is in contact with the heat sink at a portion of the reflector that is positioned on a unit rear side relative to the two left and right fastening positions of the reflector.

10. The lamp unit according to claim 7, further comprising:

a projection lens that allows reflective light from the reflector to be incident on the unit front side relative to the light emitting element, and a lens holder that supports the projection lens, wherein the reflector includes a second contact portion that is in contact with the lens holder at a portion of the reflector that is positioned on the unit front side relative to the two left and right fastening positions of the reflector.

11. The lamp unit according to claim 7, wherein the light emitting element is mounted on an upper surface of the heat sink, and the upper surface of the heat sink is formed by an inclined surface in which a region on which the light emitting element is mounted and a region on which the reflector is fastened are inclined downward toward the unit rear.

12. A power supply attachment for supplying power to a light emitting element and in which a pair of bus bar electrodes are embedded in an insulating member in a state where a part of the bus bar electrodes is exposed, wherein a pair of first terminal portions electrically connected to the light emitting element and a pair of second terminal portions electrically connected to an external power source are formed by an exposed portion of the pair of bus bar electrodes from the insulating member, an opening that exposes the pair of first terminal portions and the connector portion that accommodates the pair of second terminal portions are formed in the insulating member, and the pair of second terminal portions are disposed side by side in a horizontal direction in an internal space of the connector portion.

13. The power supply attachment according to claim 12, wherein the connector portion is formed at a position overlapping the opening with respect to a first direction in which the pair of second terminal portions are disposed side by side.

14. The power supply attachment according to claim 12, wherein each of the pair of second terminal portions is formed in a plate shape, and a plate surface faces a second direction orthogonal to the first direction in which the pair of second terminal portions are disposed side by side.

15. A lamp unit comprising: the power supply attachment according to claim 12; an optical member that controls light emitted from the light emitting element; and a heat sink that supports the light emitting element, the power supply attachment, and the optical member, wherein a recessed portion that accommodates at least a part of the connector portion is formed in the heat sink.

16. The lamp unit according to claim 15, wherein an engagement hole that engages the connector portion with a connector on an external power source side is formed in an upper wall portion of the connector portion.

* * * * *